US006256800B1

(12) United States Patent
Isbit

(10) Patent No.: US 6,256,800 B1
(45) Date of Patent: Jul. 10, 2001

(54) TOILET ACCESSORY

(76) Inventor: Jonathan P. Isbit, Suite 414, 639 Whispering Hills Rd., Boone, NC (US) 28607

( * ) Notice: Subject to any disclaimer, the term of this patent is extended or adjusted under 35 U.S.C. 154(b) by 0 days.

(21) Appl. No.: 09/450,666

(22) Filed: Nov. 30, 1999

(51) Int. Cl.[7] ..... E03D 11/00
(52) U.S. Cl. ..... 4/254
(58) Field of Search ..... 4/254, 239, 905, 4/667; 297/16.1; 108/121, 125, 130–132

(56) References Cited

U.S. PATENT DOCUMENTS

| | | | | |
|---|---|---|---|---|
| 923,344 | * | 6/1909 | Faller | 4/254 |
| 1,163,263 | * | 12/1915 | Rudduck | 4/254 |
| 1,482,073 | * | 1/1924 | Ferdinand | 297/16.1 |
| 1,726,144 | * | 8/1929 | Everts | 108/131 |
| 2,478,271 | * | 8/1949 | Isherwood et al. | 108/131 |
| 4,819,277 | * | 4/1989 | Sikirov | 4/254 |
| 5,809,583 | * | 9/1998 | Pucciani | 4/254 |
| 6,015,185 | * | 1/2000 | Buono | 297/16.1 |

FOREIGN PATENT DOCUMENTS

| | | | | |
|---|---|---|---|---|
| 3607310 | * | 3/1988 | (DE) | 4/254 |

* cited by examiner

*Primary Examiner*—Charles R. Eloshway

(57) ABSTRACT

Toilet Accessory with a frame capable of fitting over a standard toilet, an angled rigid platform fitting on top of the frame, the platform having a cutout to allow a person to use the toilet in the natural squatting position, and hinge elements to allow the frame to go from a folded flat position to an open rectilinear position. A preferred embodiment includes having the platform angled to approximately six degrees.

6 Claims, 5 Drawing Sheets

TOILET ACCESSORY

BACKGROUND OF THE INVENTION

This invention relates generally to the field of toilets, and more particularly to a toilet accessory.

Since time immemorial man has used the squatting position to perform his bodily functions. Infants of every culture instinctively adopt this posture as the most comfortable and effective way to relieve themselves. The modern seat-like toilet, on the other hand, is a relatively recent innovation. It was invented in Western Europe a few centuries ago, as a way of distinguishing "civilized man" from the "primitive peoples" who inhabit the rest of the world.

This deviation from the human body's natural mode of functioning is considered by many health practitioners to be a factor in a number of disorders that affect the people of westernized countries. Complaints such as constipation, hernias (from straining on the toilet), hemorrhoids (from pressure on the rectum in the sifting position) and twisted colon syndrome (from misalignment of the intestines) are some of the ailments linked to the use of the seat-like toilet. In addition, experts in colon cleansing have asserted that the areas of the colon most susceptible to malignant tumors are the same areas which are not fully evacuated in the sitting posture.

Reports of the beneficial effects of switching from the sitting to the squatting position include greater speed and comfort in elimination and relief from hemorrhoids. Persuasive clinical data on the use of-this method to treat hemorrhoids appears in U.S. Pat. No. 4,819,277 held by Berko Sikirov.

Another motivating factor behind the present invention is to provide a simple and inexpensive way for immigrants to westernized countries to use the toilet in the way they are accustomed to.

PRIOR ART

In the full, natural, squatting position the entire weight of the body rests on the feet. Neither the buttocks or any other part of the body is in contact with any surface. Numerous inventions have adapted the modem toilet for use in a "semi-squatting" position where the buttocks bears the weight of the body and the feet are elevated so as to bring the knees closer to the chest. However, only one patent in recent decades has been found for a device that achieves the full natural squatting position. This is the Sanitary Appliance referred to above, invented by Berko Sikirov (U.S. Pat. No. 4,819,277). This invention does not, however, take into account the following important factors which would affect its acceptance in the United States on a large scale:

1. It requires considerable time, effort and skill to install and remove.
2. It imposes an inconvenience on guests and other members of the household who prefer to use the conventional sitting position. The unsanitary underside of the device would actually be in contact with the back of a person sifting on the toilet seat.
3. In social situations where the device might prove an embarrassment, it cannot be easily removed. A similar difficulty would arise when one changes his or her place of residence.
4. It puts pressure on a toilet not designed to handle the weight of a squatting person. It poses a danger of cracking the thin porcelain forming the walls of the toilet bowl.

5. It includes a "urinal pan" which adds an unnecessary complication to the use and manufacturing of the device.
6. Most Americans do not have enough flexibility in their Achilles' tendons to squat on a level surface. They would fall backwards. Therefore, a device usable by the average American would need a platform which is inclined forwards (at least six degrees).

As will become apparent, all of the above shortcomings of Sikirov's sanitary appliance are eliminated in the design of the present invention.

SUMMARY OF THE INVENTION

The primary object of the invention is to provide a portable toilet accessory that allows a person to use the natural squatting position on a conventional toilet.

Another object of the invention is to provide a toilet accessory that collapses to a relatively flat configuration for storage or shipping.

Another object of the invention is to provide a toilet accessory that includes an angled platform that makes it easier for a person to balance in a squatting position.

Other objects and advantages of the present invention will become apparent from the following descriptions, taken in connection with the accompanying drawings, wherein, by way of illustration and example, an embodiment of the present invention is disclosed.

Summary: A toilet accessory comprising a frame capable of fitting over a standard toilet, an angled rigid platform fitting on top of said frame, said platform having a cutout to allow a person to use the toilet in the natural squatting position, and hinge elements to allow said frame to go from a folded flat position to an open rectilinear position.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
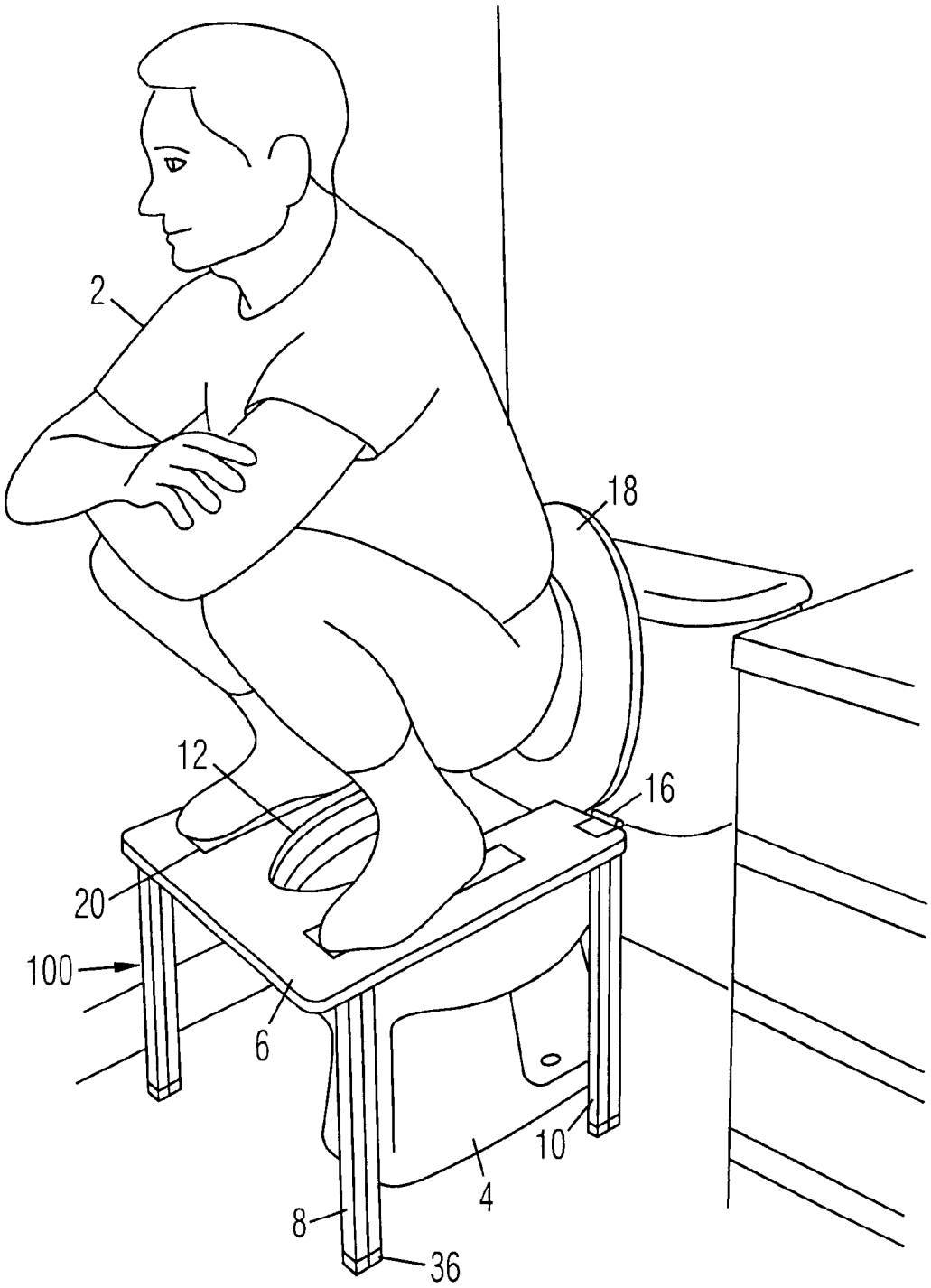
FIG. 1 is a perspective view of a person using the toilet accessory of the present invention.
Figure 2:
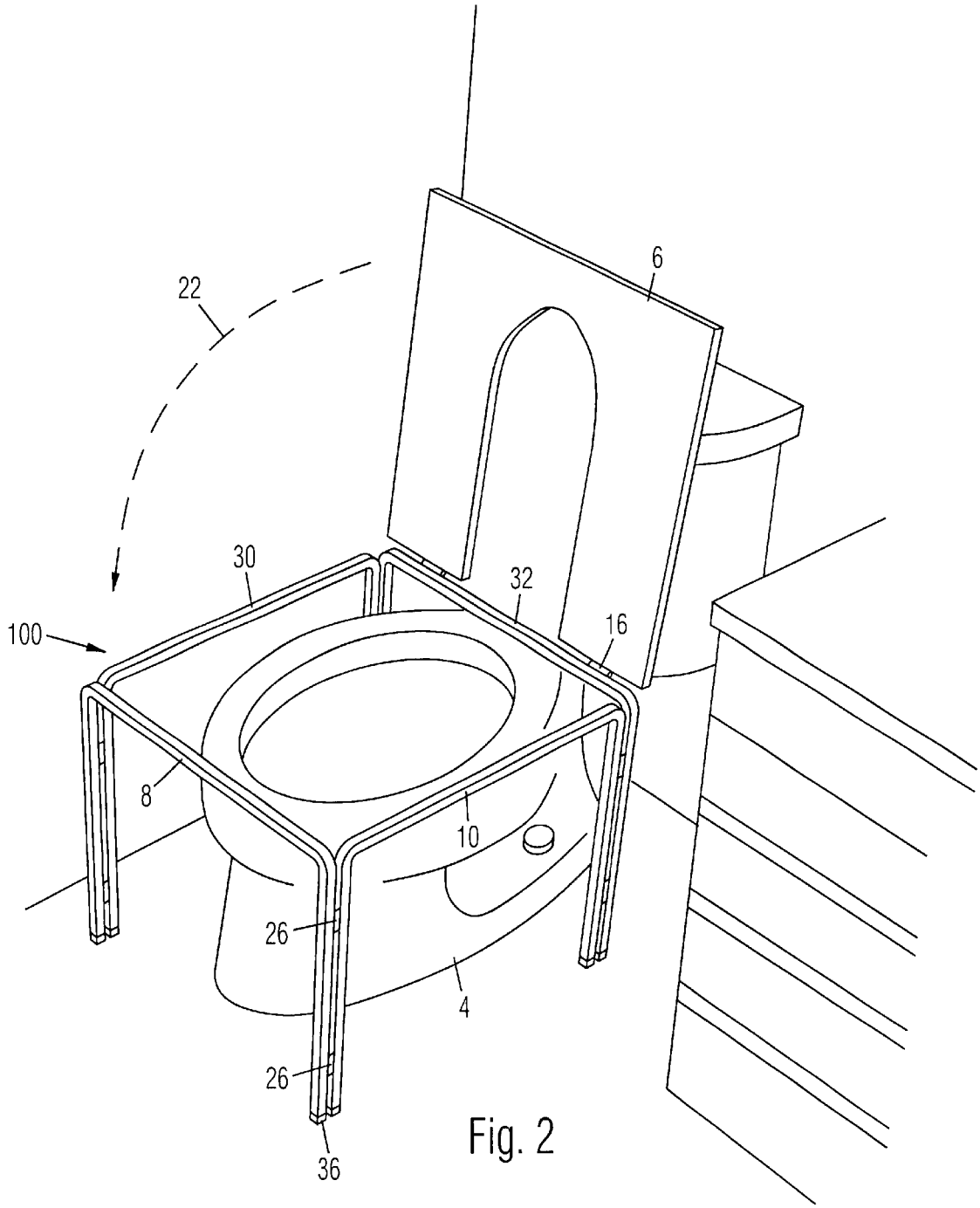
FIG. 2 is a perspective view of the toilet accessory of the present invention with the platform in the raised position.
Figure 3:
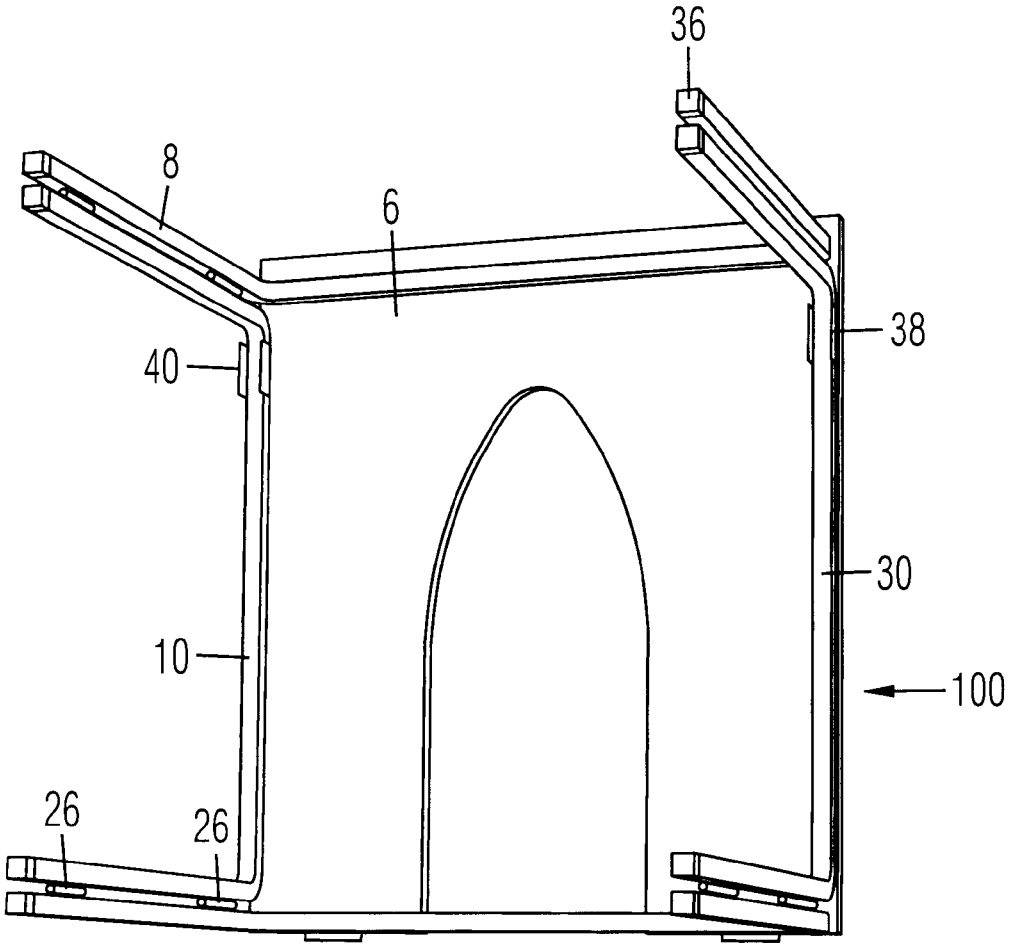
FIG. 3 is a perspective view of the underside of the present invention.
Figure 4:
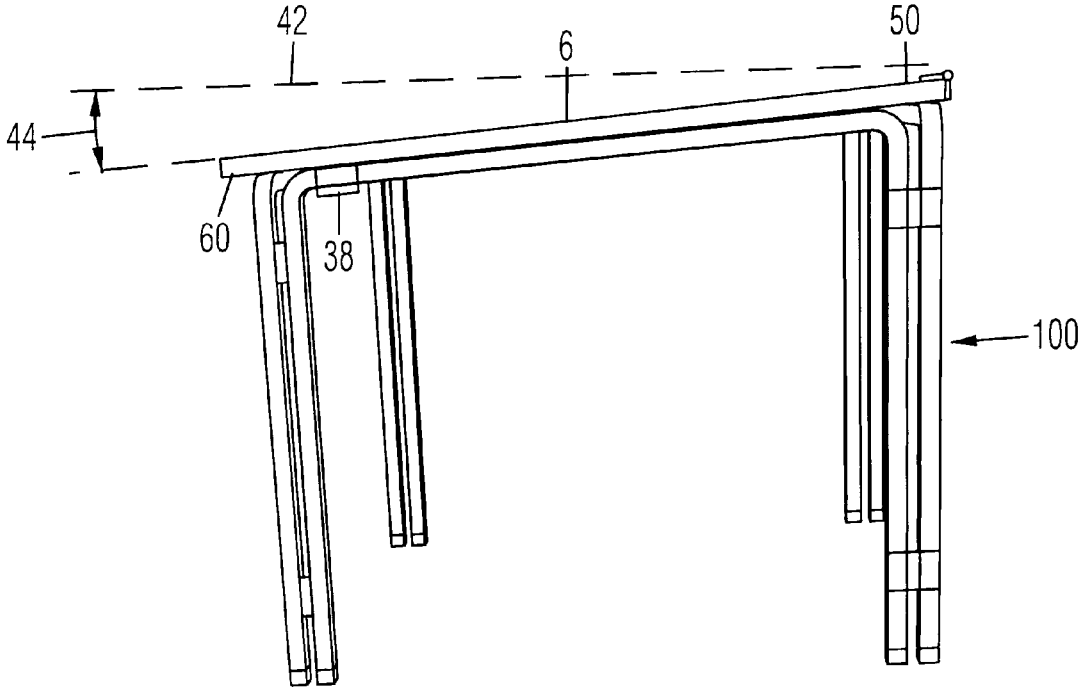
FIG. 4 is a side view of the present invention.
Figure 5:
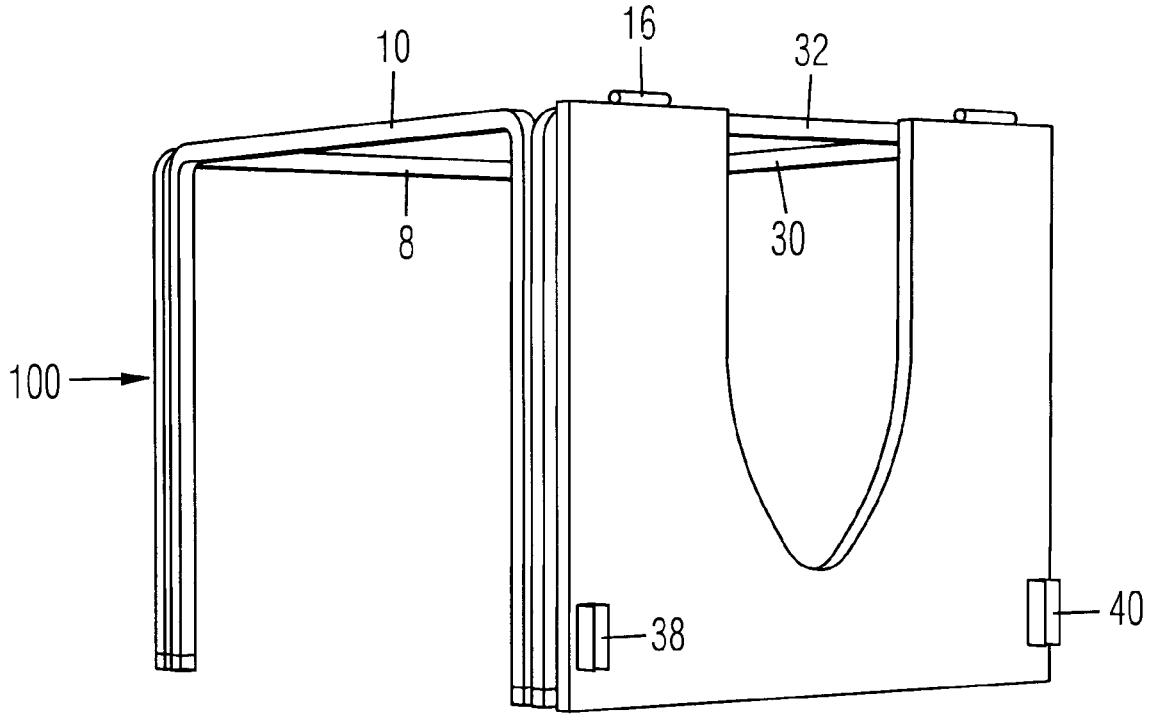
FIG. 5 is a collapsed view of the present invention.

Referring now to FIG. 1 we see a perspective view of a person (2) squatting on top of the toilet accessory (100) of the present invention. The frame portion is composed of four U-shaped rigid members (8, 10, 30, and 32), made of strong tubular material such as steel or aluminum, and supports the platform (6). The plafform(6) is made of rigid material such as wood, molded plastic, or sheet metal. Anti-skid strips (20) keep the user from slipping on the platform (6). The cutout (12) in the platform (6) allows bodily wastes to pass into the conventional toilet (4). The entire assembly (100) of the present invention fits easily over all standard toilets. The anti-skid feet (36) located at the bottom portion of all support members (8, 10, 30 and 32) helps prevent the unit (100) from sliding or scuffing the floor of the bathroom where the unit (100) is located. The unit (100) is designed to allow the seat and cover.(18) of the standard toilet to remain in its normal "up" position. FIG. 2 shows the present invention (100) with the platform (6) swung up (22) to its raised position. This position allows a male user to urinate without removing the device (100). Hinges (16) allow the platform (6) to swing up. Inverted U-shaped frames (8, 10, 30 and 32) can be clearly seen. Each U-shaped member is hinged (26) one to the other so that when the device (100) is removed from use it can be collapsed to a flat storage configuration (as shown in FIG. 5). FIG. 3 shows the present invention as it is flipped on its back. This view shows how the inverted U-shaped members (30, 10) are retained in the proper orientation by small U-brackets (38, 40) which engage when the platform (6) is swung onto the frame (8, 10, 30 and 32). FIG. 4 shows a side view of the present invention (100) and shows that the platform (6) is angled in a downward position, being higher in the rear (50) and lower in the front (60). The angle (44) that is created between imaginary horizontal line (42) and platform (6) is approximately six degrees. This angle (44) helps the user more easily balance on top of the platform (6) and creates a natural alignment of the user's torso with respect to the toilet (4) as shown in FIG. 1.

In this way the present invention provides a solution to those people who have grown up in countries that favor a squatting position and have emigrated to locations where sitting-type toilets are the norm. Additionally, even those people brought up in western environments will find that the squatting posture, which is facilitated by the present invention, provides a more natural and effective way to perform bodily functions. The present invention is relatively lightweight, can be set up in seconds, and can be removed and collapsed to the storage position quickly and easily. In spite of its light weight, the unique design of the frame makes the structure capable of supporting extremely heavy people without danger. Being self-supporting, the invention does not put any pressure on the toilet.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A toilet accessory for allowing a user to squat over an existing toilet having a toilet bowl, the accessory comprising:

a rigid platform for supporting the user in a squat position over the toilet bowl, the platform having a plurality of corners and a hole therethrough for allowing waste from the user to be deposited into the toilet bowl; and a collapsible frame supporting the rigid platform in a position inclined from front to back, the frame being sized to fit around the existing toilet bowl, the frame having four U-shaped members forming eight legs, the legs of one U-shaped member being hinged to the legs of adjacent U-shaped members such that, when the frame is unfolded from a collapsed storage position to a use position around the toilet bowl, each corner of the rigid platform is underlain and supported by two hinged legs.

2. A toilet accessory according to claim 1, wherein the rigid platform is inclined approximately 6 degrees from front to back.

3. A toilet accessory according to claim 1, wherein each leg has a non-skid rubber enclosure on a bottom thereof to prevent slippage of the frame.

4. A toilet accessory according to claim 1, wherein the rigid platform is hingedly connected to one of the U-shaped members.

5. A toilet accessory according to claim 1, wherein the rigid platform includes a plurality of non-skid friction strips attached thereto.

6. A toilet accessory according to claim 1, wherein the rigid platform includes U-brackets on the undersurface into which the U-shaped members fit, for locking the U-shaped members in the use position.

* * * * *

UNITED STATES PATENT AND TRADEMARK OFFICE

CERTIFICATE OF CORRECTION

PATENT NO. : 6,256,800 B1
DATED : July 10, 2001
INVENTOR(S) : Jonathan P. Isbit

It is certified that error appears in the above-identified patent and that said Letters Patent is hereby corrected as shown below:

Column 1,
Line 20, “sifting” should read -- sitting --.
Line 30, “of-this” should read -- of this --.
Line 59, “sifting” should read -- sitting --.

Column 3,
Line 2, “plafform” should read -- platform --.

Signed and Sealed this

Second Day of July, 2002

*Attest:*

*Attesting Officer*

JAMES E. ROGAN
*Director of the United States Patent and Trademark Office*